United States Patent [19]

Friese et al.

[11] 4,406,968

[45] Sep. 27, 1983

[54] SPARKPLUG FOR INTERNAL COMBUSTION ENGINE

[75] Inventors: Karl-Hermann Friese, Leonberg; Rudolf Pollner, Bamberg, both of Fed. Rep. of Germany

[73] Assignee: Robert Bosch GmbH, Stuttgart, Fed. Rep. of Germany

[21] Appl. No.: 297,353

[22] Filed: Aug. 28, 1981

[30] Foreign Application Priority Data

Oct. 14, 1980 [DE] Fed. Rep. of Germany ..... 3038720

[51] Int. Cl.[3] ..... H01T 13/20

[52] U.S. Cl. ..... 313/136; 313/137; 313/141

[58] Field of Search ..... 313/136, 137, 138, 141, 313/141.1, 130, 131 R, 131 A, 142, 143, 145

[56] References Cited

FOREIGN PATENT DOCUMENTS 1208120 12/1965 Fed. Rep. of Germany .
2440454 8/1975 Fed. Rep. of Germany .
198345 3/1924 United Kingdom .

*Primary Examiner*—Alfred E. Smith

*Assistant Examiner*—K. Wieder

*Attorney, Agent, or Firm*—Frishauf, Holtz, Goodman & Woodward

[57] ABSTRACT

A sparkplug for internal combustion engines which has a central electrode extending to the ignition end. The central electrode has an electrically non-conductive core pin with an electrically conductive outer layer on the cylindrical surface of the core pin. The central electrode is positioned in the lengthwise bore of the sparkplug insulator portion, preferably without any clearance between the insulator and the ignition end portion of the central electrode. The core pin is preferably made of a material which has shrinkage characteristics and a thermal coefficient of expansion substantially the same as those of the insulator. Most preferably the same material is used for both components. The electrically conductive coating layer of the central electrode is preferably a conductive metal-ceramic mixture. The coating layer may be in the form of a resistance element and/or contain a pre-ignition discharge gap. The sparkplug may also be formed with a recessed electrically conductive coating portion of the central electrode to form a surface gap sparkplug.

15 Claims, 3 Drawing Figures

SPARKPLUG FOR INTERNAL COMBUSTION ENGINE

The present invention provides sparkplugs for internal combustion engines having good operating characteristics which are retained over a long service life.

BACKGROUND OF THE INVENTION

Sparkplugs for internal combustion engines such as those disclosed in German Patent Disclosure document No. 24 04 454 and German Patent No. 1 208 120 have a metallic cylindrical or tubular housing which has a ground electrode in its ignition end. The metallic housing envelops an insulator which has a lengthwise bore. The ignition end of the sparkplugs contains an electrical connecting pin extended inwardly in the bore of the insulating portion of the sparkplug. The known sparkplugs have the disadvantage that because different materials are used for the insulator and for the central electrode (connecting pin) stresses may be set up between them, particularly under operating conditions which involve high temperatures which can lead to damage to the insulator.

British Patent No. 198 345 discloses sparkplugs having a central electrode which is made of a non-metallic electrically conductive material having a coefficient of thermal expansion which corresponds substantially to the coefficient of thermal expansion of the insulator. This avoids the formation of stresses between the insulator and the central electrode. However because the insulator and the non-metallic central electrode are composed of different materials, undesireable sinter reactions can occur at the contact between the insulator and the central electrode which reduce the functional reliability of the sparkplugs and sometimes also reduce their service life.

It is an object of the present invention to provide an improved sparkplug which avoids the disadvantages of the art and provides more uniform and reliable operation during its service life and which has a long service life.

THE INVENTION

The present invention provides sparkplugs for internal combustion engines having an outer metallic tubular housing surrounding an insulator which has an inner longitudinal bore. The metallic tubular housing is connected to a ground electrode at the ignition end. The inner bore of the insulator has a connecting pin at the contact end of the sparkplug positioned to make an electrical contact with a source of power. The other end of the connecting pin extends inwardly to connect with an electrically conductive material in the interior bore. Said electrically conductive material prefarably comprises large amounts of non-metallic electrical material. The inner bore also contains a central electrode in the ignition end of the sparkplug which extends inwardly into contact with said electrically conductive material. The central electrode is imbedded in the insulator and is separated from the ground electrode by the discharge gap. The central electrode is a pin (thin electrical rod) and is made of an electrically non-conductive material. The electrical contact between the electrically conductive material which is in the inner portion of the bore and the ignition end of the sparkplug is provided by a thin layer of an electrically conductive material which covers at least sufficient portions of the outside surfaces of the central electrode to provide the necessary conductive path between the electrically conductive material in the inner portion of the bore and the sparkplug gap. The electrically non-conductive material of which the central electrode is formed has a coefficient of expansion which is substanially the same as the coefficient of expansion of the insulator in which the central electrode is imbedded without any clearance between them.

It is preferred that the central electrode and the insulator should be made of the same electrically non-conductive material. It is also preferred to use an electrically conductive metal-ceramic mixture as the electrically conductive layer which is positioned between said insulator and said central electrode.

THE DRAWINGS

DETAILED DESCRIPTION OF THE INVENTION

Figure 1:
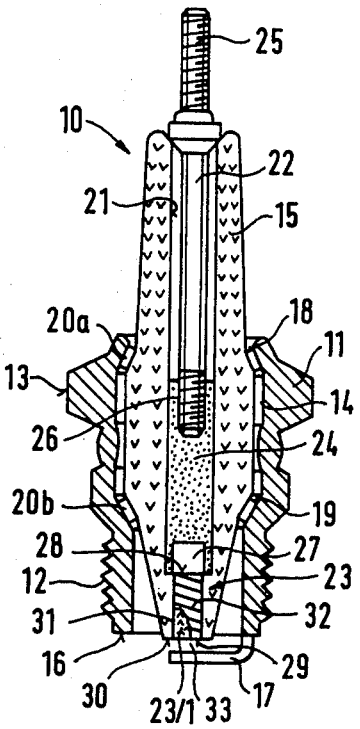
FIG. 1 is an enlarged longitudinal section through the sparkplug.

In the emobodiment of FIG. 1, the sparkplug 10 has a metallic housing 11 having an outer male thread 12 and a hexagonal collar 13 for insertion and positioning of the sparkplug in the cylinder head of internal combustion engines. The metallic housing 11 has an inner bore (space) 14 within which the major portion of the essentially tubular shaped insulator 15 is positioned. The housing 11 has a flat end surface 16 on the ignition end to which is attached a hook-shaped ground electrode 17.

The insulator 15 is positioned in the housing 11 by contact of the insulator outside shoulders 18 and 19 with interposed packing rings 20*a* and 20*b* respectively. The insulator 15 has a longitudinal bore 21 in which the central electrode 23 is positioned at the ignition end of the sparkplug and the connector pin 22 is positioned at the opposite (contact) end of the sparkplug. The connector 22 and the central electrode 23 are electrically connected by an electrically conductive sealing matrix material 24 positioned and tightly packed in the interior of bore 21. The electrically conductive sealing matrix 24 is composed of conventional materials known for this purpose.

The cylindrical connector 22 extends out of the longitudinal bore at the contact end of the sparkplug. The portion of the connector 22 extending outside of the sparkplug has an outside thread 25 for connection to an electrical source which is not depicted in the drawings. The other end of the connector 22 has an end portion anchoring means 26 embedded in the matrix 24.

The central electrode 23 has a head portion 27 which is in contact with the matrix 24 and is positioned upon the shoulder 28 in the longitudinal bore 21 of the insulator 15. This serves to fix the position of the central electrode 23 in the longitudinal direction. The head 27 of the central electrode may have protrusions and/or indentations to better anchor the central electrode in the matrix 24. In the embodiment of FIG. 1, the flat end surface 29 of the central electrode on the ignition end of the sparkplug is flush with the flat end face 30 of the insulator 15. In some internal combustion engines the flat end face 29 may protrude beyond the flat end face 30 of the insulator in the direction of the ignition end of the sparkplug and in another embodiment, the flat end face 29 of the central electrode may be recessed in the longitudinal bore 21 of the insulator 15.

The central electrode 23 comprises an electrically non-conductive pin or core 23/1 and an electrically conductive layer 31 which is resistant to thermal erosion on the outside walls of the pin 23/1 and extending in electrical contact with the matrix 24 and the electrode face 29. The core pin 23/1 is preferably composed of substantially the same material, for example aluminum oxide, as the insulator 15 and therefore displays the same shrinkage characteristics as the insulator 15 at the sintered interface between the central electrode 23 and the insulator 15. The conductive layer 31 is preferably composed of conductive metal-ceramic mixture, for example a platinum-aluminum oxide mixture. It can also be made of a suitable single metal, for example platinum. Layer 31 is preferably about 0.05 mm thick. In the area of the end of the segment of the central electrode 23 at the ignition end of the sparkplug and particularly in the area about the flat end face 29 of the central electrode 23, the thickness of the layer 31 is frequently increased. In certain applications (embodiments) the layer 31 may not extend to the area of the flat end face 29 of the central electrode 23, i.e., it is not present in the area about the flat end face 29 in the embodiment of the invention under discussion.

The layer 31 can be formed by conventional methods including a sintering process and by plasma spraying.

The diameter of the central electrode 23 is such that it should fit without any clearance into the ignition end section of the longitudinal bore 21 of the insulator and when the insulator assembled with the central electrode 23 in the central bore is sintered together, a secure and tight connection between them is formed.

In a preferred embodiment of the invention, the electrically conductive layer 31 covering portions of the outer wall of the cylindrical pin 23/1 has a spiral groove 32 cut through a portion or all of the layer 31 thereby converting the layer 31 into a resistance element positioned very close to the discharge path 33 to provide an excellent suppression effect on interference waves.

The electrically conductive layer 31 can also be manufactured by depositing an electrically conductive material directly on the surface of the pin 23/1 by way of thickfilm technique. Materials for layers 31 consist for example of cermets, aluminum oxide admixed with metallic platinum, semi-conductive materials, for example an admixture of $Fe_2O_3/Al_2O_3$ also admixed with metallic platinum.

Figure 3:
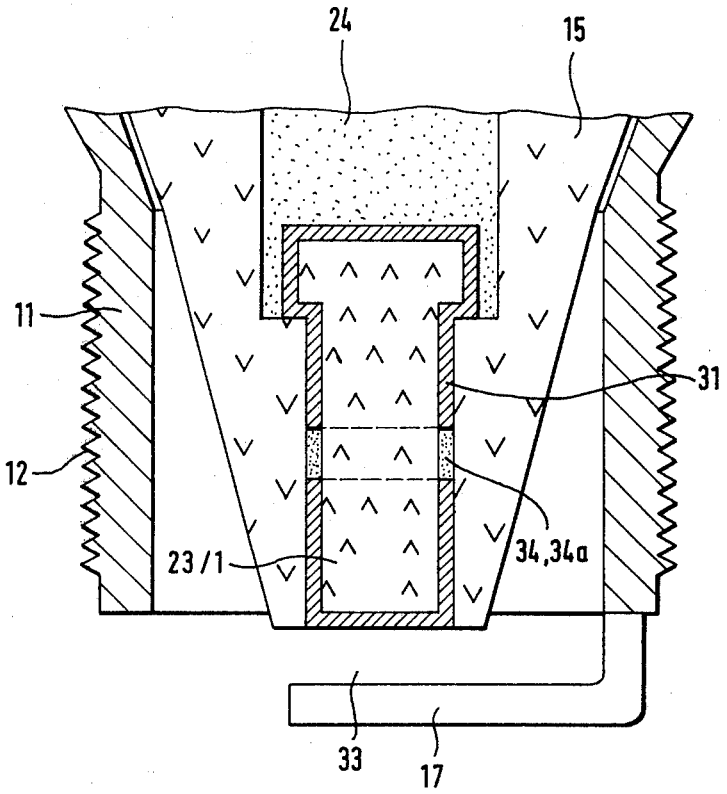
FIG. 3 is an enlarged longitudinal section of the ignition end of still another embodiment of the sparkplug of the present invention.

The electrically conductive layer 31 can also contain a pre-spark gap 34 as shown in FIG. 3. The pre-spark gap may merely be a single discontinuity in the electrically conductive path of the layer 31, for example in the shape of a ring encircling the pin 23/1. When the pin 23/1 having a coating of the conductive layer 31 on the outer surface is sintered in contact with the inner surface of the longitudinal bore 21 of the insulator, the gap or discontinuity 34 maybe filled with a porous coating 34*a*, for example aluminum oxide, magnesium-spinel, and similar materials which may be utilized without any flux additive. The embodiment of the invention utilizing the pre-spark gap may be utilized in conjunction with a conductive layer 31 which largely covers the outside walls of the pin 23/1 or in conjunction with the embodiment wherein the conductive layer 31 forms a resistance element, for example in the form of a spiral. In both embodiments, there would be at least one discontinuity (gap) which maybe filled with a porous material as noted herein before to form the pre-spark gap.

The sparkplugs of the present invention may also be made in the form of surface gap sparkplugs. In this embodiment of the invention, the ignition end portion of the pin 23/1 is maintained free of the electrically conductive coating 31, i.e., there is no electrically conductive coating 31 on the segment of the pin 23/1 adjacent the ignition end of the sparkplug. In this embodiment, when the central electrode 23 is sintered into the longitudinal bore 21 of the insulator, the space around the ignition end segment of the pin 23/1 which is free of the electrically conductive coating 31 is preferably filled with a porous coating of a material such as aluminum oxide or glass. When the sparkplug is formed by assembling the central electrode 23 in the longitudinal bore 21 with some clearance between them, the porous coating can be omitted.

In place of the aforedescribed method of inserting and assembling the central electrode 23 in the insulator 15, it is also possible to form the central electrode 23 which contains the electrically conductive coating 31 by sintering to form the completed electrode 23 and then positioning it in the inner bore 21. The end of the central electrode 27 is firmly and compactly embedded in the matrix 24 which positions the central electrode 23. In this embodiment a small clearance between the central electrode 23 and the longitudinal bore 21 is permissible.

When different materials are utilized for the manufacture of the insulator 15 and the pin 23/1, the shrinkage behavior of the pin 23/1 maybe modified by pre-sintering it slightly and then coating the electrode pin 23/1 and then positioning the coated central electrode 23 in the longitudinal bore 21 and final sintering the assembly.

Depending upon the shape of the pin 23/1 including the head portion 27 thereof, it can be formed by extrusion, pressing in a press, or injection molding.

Figure 2:
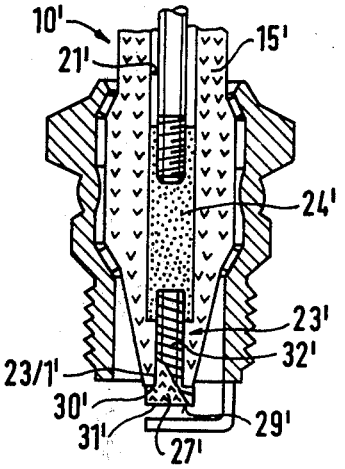
FIG. 2 is an enlarged longitudinal section through the ignition end portion of another embodiment of the sparkplug of the present invention.

The sparkplug 10' depicted in FIG. 2 differs from the sparkplug 10 of FIG. 1 in that the central electrode 23' has a head 27' which is positioned as the spark emission area on the flat end face 30' of the insulator 15' at the ignition end thereof. Because the head 27' bears against the flat end face 30' of the insulator, the appropriate position of the central electrode 23' in the longitudinal bore 21' of the insulator 15' is also insured (fixed). The flat end face 29' of the central electrode 23' is preferably also covered with an electrically conductive layer 31'. Due to the larger diameter of the flat end face 29' of the central electrode compared to the flat end face 29 of the central electrode of the spark plug 10 depicting in FIG. 1, superior ignition of the gaseous fuel-air mixture in the spark gap 33' is effected. The remaining structure and the formation (mounting) of the central electrode 23' in the insulator 15' corresponds basically to the design of the sparkplug 10 depicted in FIG. 1.

It is an advantage of the sparkplugs of the present invention containing the central electrode 23, 23', that the central electrode remains functionally active even if a part of the coating 31, 31' should be burned off. This results because there is then formed a so called combined surface discharge gap-air discharge gap. Such a combined surface discharge gap-air discharge gap requires only a slighter higher triggering voltage then the corresponding air discharge gap.

In the preferred embodiment of the invention in which the same material is used for the insulator 15, 15' and for the pin 23/1, 23/1' of the central electrode, the undesireable reactions which occured in the prior art at the sintered connection between the central electrode and the insulator and which could eventually lead to stress and occasional disruption of the insulator, are avoided. The product sparkplugs of the present invention have a uniform quality.

When the central electrodes 23, 23' have a coating 31, which is not in the form of a spiral because, for example, it does not have the spiral groove 32, and therefore the central electrode does not function as a resistance element, the sparkplug may be designed with a resistance element intergrated in (placed in or embedded in) the electrical circuit of the electrically conductive sealing matrix 24, 24' as disclosed in U.S. Pat. No. 3,909,459. A sparkplug having the resistance element in the matrix of 24, 24' can in other respects include the features of the embodiments of the sparkplugs of the present invention such as those depicted in the drawings.

An example of the manufacture of a sparkplug of the present invention such as that described in the preceding paragraph follows:

Insulator 15 is made of 95 percent by weight of alumina and 5 percent by weight of a flux additive (e.g. calcium silicate), preformed including its longitudinal bore 21 by means of the well known isostatic press-molding process and shaped by grinding.

The central electrode pin 23/1 is made of 84 percent by volume alumina (contains 5 percent by weight of a flux additive as e.g. calcium silicate) and 16 percent by volume of an organic additive and is preformed by thermoplastic injection molding, whereafter it is presintered at about 900° C. for about 2 hours; the organic additive is e.g. consisting of 19 percent by weight of a synthetic resin the softening temperature of which is about 105° C., 42 percent by weight polyvinylacetate, 12 percent by weight beet oil fatty acid, 12 percent by weight dibutylphtalat and 15 percent by weight gas oil.

To deposit the electrically conductive layer 31 on the surface of the pin 23/1 the presintered an cooled pin 23/1 is immersed in a suspension of alumina and platinum in an organic oil (e.g. oils of turpentine) provided with an adhesive (e.g. 3 percent by weight ethyl cellulose related to the solids of the suspension); the electrically conducting layer 31 consists of 60 percent by volume platinum and 40 percent by volume alumina and is between about 0.005 and 0.08 mm thick, preferably between about 0.02 and 0.06 mm thick and has in the best mode a thickness of about 0.05 mm.

The coated pin 23/1 is then inserted into the longitudinal bore 21 of the insulator 15, where it is properly located and finally sintered together with the insulator 15 at about 1600° C. for about 2 hours.

The following steps of the manufacturing of sparkplugs are well known and need not be described.

It should be added that the sealing matrix 24 is a mixture of glas, graphite and iron powder (see e.g. U.S. Pat. No. 3,360,676), that the connecting pin 22 is made of unalloyed steel and that the center electrode 23, 23' has a diameter of about 2.8 mm.

We claim:

1. An improved sparkplug for internal combustion engines comprising a metallic generally tubular housing having a ground electrode at its ignition end, said metallic housing having an inner bore enveloping insulator which has a longitudinal bore, said longitudinal bore having an electrical connecting pin extending inward through the contact side of the sparkplug and contacting an electrically conductive matrix material in the inner portion of said longitudinal bore, and said longitudinal bore having a central electrode in contact with said electrically conductive matrix material and extending to the ignition end of said sparkplug and being separated from said ground electrode by a discharge gap, the improvement comprising said central electrode comprising a core pin composed of an electrically non-conductive material and having an electrically conductive coating on the outer walls of said core pin which is in electrical contact with said matrix material and the ignition end portion of said sparkplug, said electrically non-conductive material forming said core pin having a thermal coefficient of expansion substantially the same as the thermal coefficient of expansion of said insulator.

2. The sparkplug of claim 1 wherein said central electrode and said insulator are sintered together.

3. The sparkplug of claim 1 or claim 2 wherein said core pin has shrinkage characteristics which during the sintering operation are substantially the same as those of said insulator.

4. The sparkplug of claim 1 wherein said core pin is composed of essentially the same material as said insulator.

5. The sparkplug of claim 2 wherein said core pin is composed of essentially the same material as said insulator.

6. The sparkplug of claim 1 or 4 or 5 wherein said electrically conductive layer comprises an electrically conductive metal-ceramic material.

7. The sparkplug of claim 1 wherein said electrically conductive layer has an increased thickness at the ignition end of said central electrode.

8. The sparkplug of claim 1 wherein said electrically conductive layer is a resistance element on a portion of the outer surface of said core pin.

9. The sparkplug of claim 1 or 4 or 5 wherein said electrically conductive layer is a resistance element on a portion of the outer surface of said core pin.

10. The sparkplug of claim 1 wherein said electrically conductive layer has at least one gap in the conductive path thereby forming a pre-ignition discharge gap.

11. The sparkplug of claim 2 or 4 or 8 wherein said electrically conductive layer has at least one gap in the electrically conductive path and said gap is filled with a porous material thereby acting as a pre-ignition discharge gap.

12. The sparkplug of claim 1 wherein the ignition end portion of the outer surface of said core pin is not covered by said electrically conductive layer.

13. The sparkplug of claim 1 or 4 or 5 wherein said electrically conductive layer has at least one gap in the electrically conductive path and said gap is filled with a porous material thereby acting as a pre-ignition discharge gap and wherein the surface of said core pin which is not covered by said electrically conductive layer is covered by a porous ceramic material.

14. The sparkplug of claim 1 wherein said central electrode has an elongated head end section positioned in said matrix material.

15. The sparkplug of claim 1 wherein said central electrode has an elongated head end section positioned adjacent the ignition end of said insulator.

* * * * *